US005472111A

United States Patent [19]

Renfrew

[11] Patent Number: 5,472,111

[45] Date of Patent: Dec. 5, 1995

[54] PAINT ROLLER TRAY

[75] Inventor: Bruce Renfrew, Leicester, United Kingdom

[73] Assignee: Imperial Chemical Industries PLC, London, England

[21] Appl. No.: 307,069

[22] Filed: Sep. 16, 1994

[30] Foreign Application Priority Data

Sep. 16, 1993 [GB] United Kingdom ..... 9319187

[51] Int. Cl.[6] ..... B05C 21/00

[52] U.S. Cl. ..... 220/570; 220/212; 220/697; 220/700; 206/508; 15/257.05; 15/257.06

[58] Field of Search ..... 220/212, 570, 220/695, 697, 699, 700, 736; 206/508; 248/110; 15/257.05, 257.06

[56] References Cited

U.S. PATENT DOCUMENTS

| | | | |
|---|---|---|---|
| 2,698,450 | 1/1955 | Mack | 220/699 X |
| 2,977,624 | 4/1961 | Tarr | 15/257.06 |
| 3,828,389 | 8/1974 | Heisler | 15/257.06 |
| 4,928,843 | 5/1990 | Gunderson | 220/212 X |
| 5,085,317 | 2/1992 | Jensen et al. | 15/257.06 X |

FOREIGN PATENT DOCUMENTS

| | | | |
|---|---|---|---|
| 4123513 | 1/1993 | Germany | 220/697 |

*Primary Examiner*—Allan N. Shoap
*Assistant Examiner*—Stephen Cronin
*Attorney, Agent, or Firm*—Cushman Darby & Cushman

[57] ABSTRACT

A paint roller tray detachably mountable on a paint container, the container having an opening permitting access of a paint roller into the container, and the tray having a roller platform and attachment means which allow the tray to be mounted in a first and second position on the container, in the first position the attachment means are engaged so as to locate the roller platform above the container and laterally offset from the opening so as to permit insertion of a roller into the container and in the second position the attachment means are engaged to locate the roller platform immediately above the container and over the opening.

15 Claims, 6 Drawing Sheets

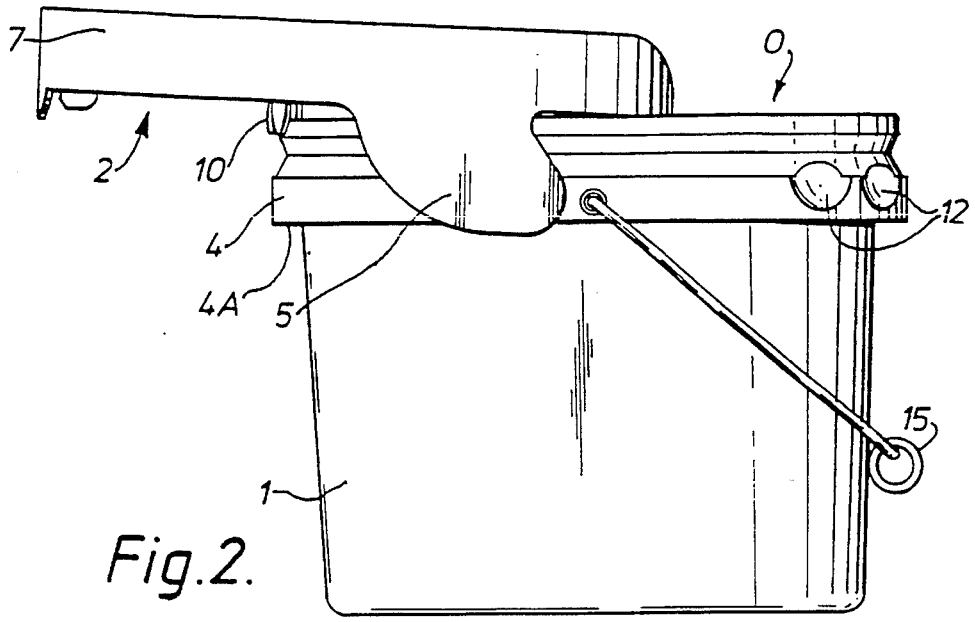
Fig.2.
Fig.7.
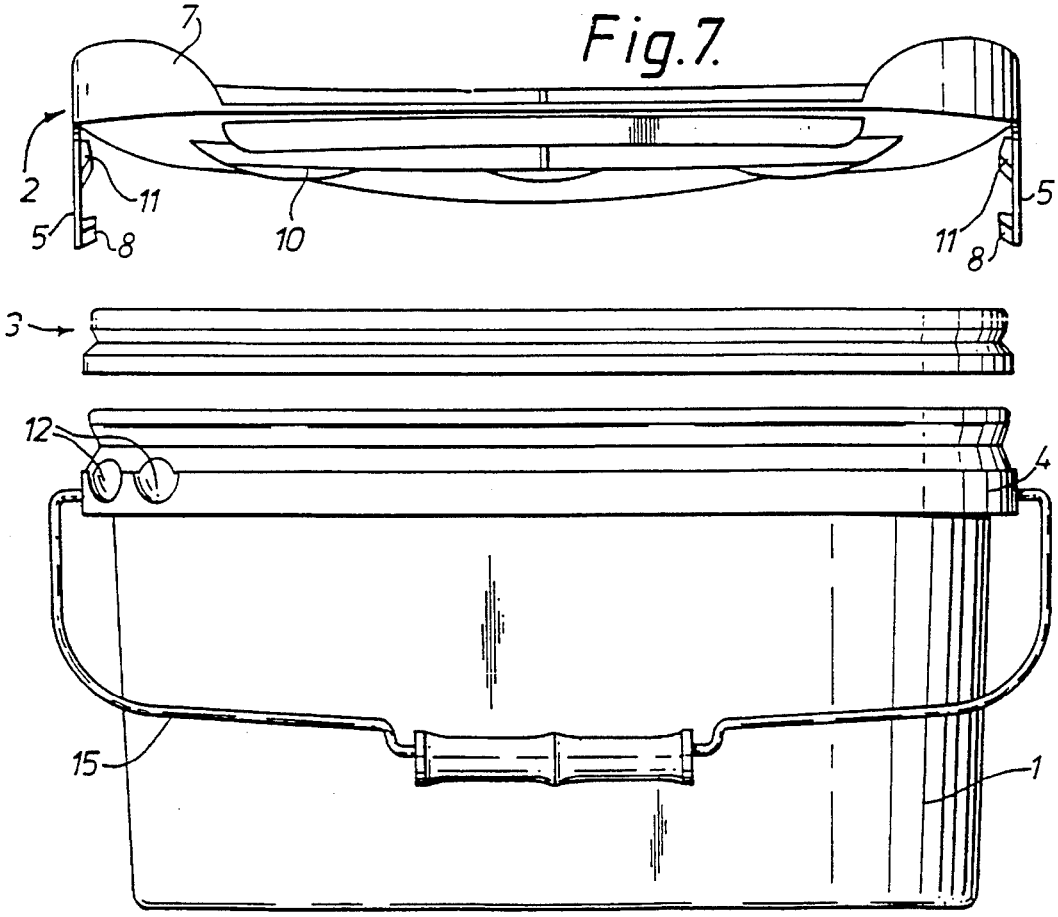

PAINT ROLLER TRAY

BACKGROUND OF THE INVENTION

1. Field of the Invention

This invention relates to a paint roller tray for use with a paint roller. The invention is particularly aimed at the DIY market in domestic paints.

2. Related Art

The use of rollers having a nap made from natural or synthetic materials such as fibers or foam to apply paints, for example, emulsion paints, is well known in both the DIY (Do It Yourself) and commercial/trade markets. However, even though an average DIY user will find painting large areas such as ceilings and walls to be much quicker using a roller rather than using a brush, there is a reluctance to use rollers. One reason for this reluctance seems to arise from the fact that paint is generally purchased in cans and must be poured into a roller tray before it can be applied to a roller. Conventional roller trays are perceived to be messy to use, to require care in cleaning and storage and to be somewhat unstable when used on step ladders.

Conventional roller trays comprise a flat surface of generally rectangular shape with an integral paint well at one end. In use, the roller is dipped into paint in the well and rolled back and forth across the flat surface to squeeze off excess paint and to distribute the paint evenly across the roller surface. The roller is then ready to be rolled across a surface to be painted so as to apply the paint thereto. Generally the flat surface of the tray is inclined slightly toward the well so that paint squeezed from the roller flows back into the well for future use.

One problem with conventional roller trays is that a user must pour paint from the original container in which it is purchased into the roller tray prior to use. This pouring operation frequently results in unwanted mess with paint splashing or running down the side of the original container.

A problem also exists when attempting to return any unused paint into the original container when painting is complete. Unused paint must either be poured back into the original container with further accompanying mess or, alternatively, thrown away. Some consumers simply pour emulsion paint down a drain, causing waste water pollution.

A further problem with conventional roller trays is that they are somewhat unwieldy and do not sit stably on conventional step ladders. The trays are somewhat larger than an average step ladder tread and so can only be reliably and stably positioned on the top of a step ladder and then only if the ladder is of the type which has a platform at the top. Often either a step ladder without a platform is used or the tray is required to be on a lower tread because of the height of an area to be painted e.g. a part of a wall. This can result in an extremely unstable situation. In some cases the tray is simply balanced on a step ladder tread from which it can easily fall with consequent spillage and disastrous results. In other cases a user steadies the tray with one hand while painting with the other hand. This restricts the ability to paint more than a small area at a time and also runs the risk that the user can fall off the steps since he has no free hand with which to support himself.

A still further problem with the traditional roller tray is that of cleaning and storage. Many DIY users buy paint for use with a roller tray on the basis that they already have a tray which was purchased previously. Not infrequently the tray has been stored after inadequate cleaning or in a location such that it has, since last used, become home for all manner of unwanted fauna. Often this means another trip to the DIY store for a new tray.

SUMMARY OF THE INVENTION

The roller tray of the present invention is designed to overcome or at least reduce some or all of these problems.

According to the present invention there is provided a paint roller tray detachably mountable on a paint container, the container having an opening permitting access of a paint roller into the container and the tray having a roller platform and attachment means which allow the tray to be mounted in a first and a second position on the container. In the first position, the attachment means are engaged to locate the roller platform above the container and laterally offset from the opening so as to permit insertion of a roller into the container. In the second position, the attachment means are engaged to locate the roller platform immediately above the container and over the opening.

According to one embodiment, when in the second position, the tray constitutes a lid which closes the access opening of the container. In this embodiment the paint container can include a sealing membrane above the paint.

According to a preferred embodiment, when in the second position, the tray is engaged with a removable lid for the container which itself closes the opening.

Preferably the container has a rim encircling the access aperture, and the attachment means engages with the rim when the tray is in at least the first or second position.

Optionally, the attachment means includes one or more lugs extending from the roller platform. Preferably having primary projections extending from the lugs which are engagable with the rim of the paint container.

In the preferred embodiment, the attachment means include secondary projections extending from the lugs which are engagable with the lid, and the edge of the lid is contoured to retain the secondary projections.

The roller platform preferably includes an embossed pattern, for example including a plurality of curves.

Advantageously the tray is inclined towards the paint container when supported in the first position wherein excess paint may drain back into the container by virtue of the inclined tray.

The tray preferably includes a raised flange extending from the roller platform around a substantial part of the periphery of the roller platform.

According to a preferred embodiment the tray is adapted to be supported by a rectangular section container.

The tray may be adapted to permit centralized stacking of the paint containers when in the second position.

A method of painting according to the present invention includes detachably supporting a paint roller tray including a roller platform in a first position located in overlapping relationship with an access opening of a paint container to permit access into the container, attachment means of the tray being engaged with the paint container.

Conveniently, the tray is designed to be inexpensive and light in weight and so that it can be sold together with, and clipped neatly onto, a lidded paint container. Thus, the user is always provided with a new tray whenever he purchases a new container of paint. The tray is also designed to clip onto the same paint container, when the lid has been removed, in such a position that a roller can be dipped into the paint and subsequently rolled on the tray so that excess paint from the roller flows back into the container. This eliminates the need to transfer paint from its original container into a separate roller tray and so automatically returns unused paint back into the original container. The combination of tray and container is preferably so shaped that, when appropriately dimensioned, the combination will sit stably on the treads of a step ladder.

BRIEF DESCRIPTION OF THE DRAWINGS

Preferred embodiments of the invention will now be described by way of example, and with reference to the drawings in which:

FIG. 2 is an end elevation of FIG. 1;

FIG. 7 is an exploded front view of the invention in the second position;

DETAILED DESCRIPTION OF THE PREFERABLY PREFERRED EXEMPLARY EMBODIMENT

Figure 1:
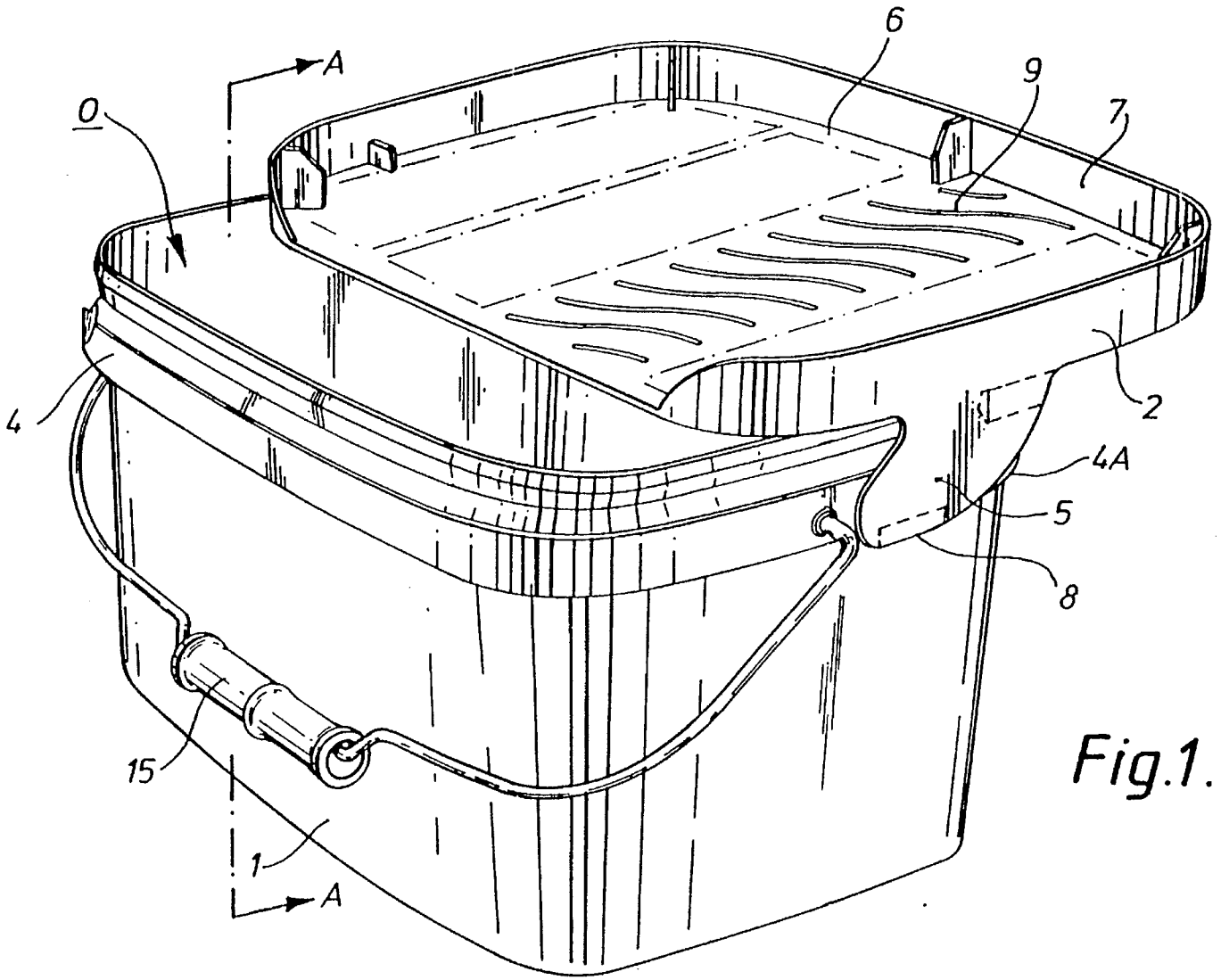
FIG. 1 is a perspective embodiment of the invention in a first and available-for-use-position.

A paint roller tray 2 is attached to a rim 4 of a paint container 1 having an access opening O by attachment means including two lugs 5. The tray 2 includes a flat roller platform 6 surrounded on three sides by a raised flange 7. The two lugs 5 extend downwardly from opposite ends of the tray 2. Each attachment lug 5 includes a lip or projection 8 (see FIGS. 1 and 8) which in the first position engages the rim 4 of the paint container 1 or, in the second position engages the rim of a lid 3 which encloses the top of the paint container 1. The tray 2 may, therefore, be supported by the paint container 1 in either of the two positions.

In a first position (see FIGS. 1 to 3), the paint container 1 is open permitting access through opening O with the tray 2 being attached to the rim 4 of the container 1. The tray 2 is disposed above and overlapping the access opening O so that a roller is insertable between the front edge of the tray 2 and the front edge of the rim 4 of the paint container 1. The attachment lugs 5 extend downwardly from the tray 2 and engage with the rim 4 of the paint container 1. For additional support, a central region of the underside of the tray 2 rests on the rim 4 of the paint container 1. In the preferred embodiment, the roller tray 2 is sold and used in conjunction with a generally rectangular paint container 1 similar to commercially available paint containers. For such containers the attachment lugs 5 engage with flat sides of the paint container 1, and so that the underside of the roller tray 2 is supported along most of its width. The rim 4 extends outwardly from the paint container 1 around the whole of the access opening O and a lip 4A allows inter engagement with the projection 8.

Figure 3:
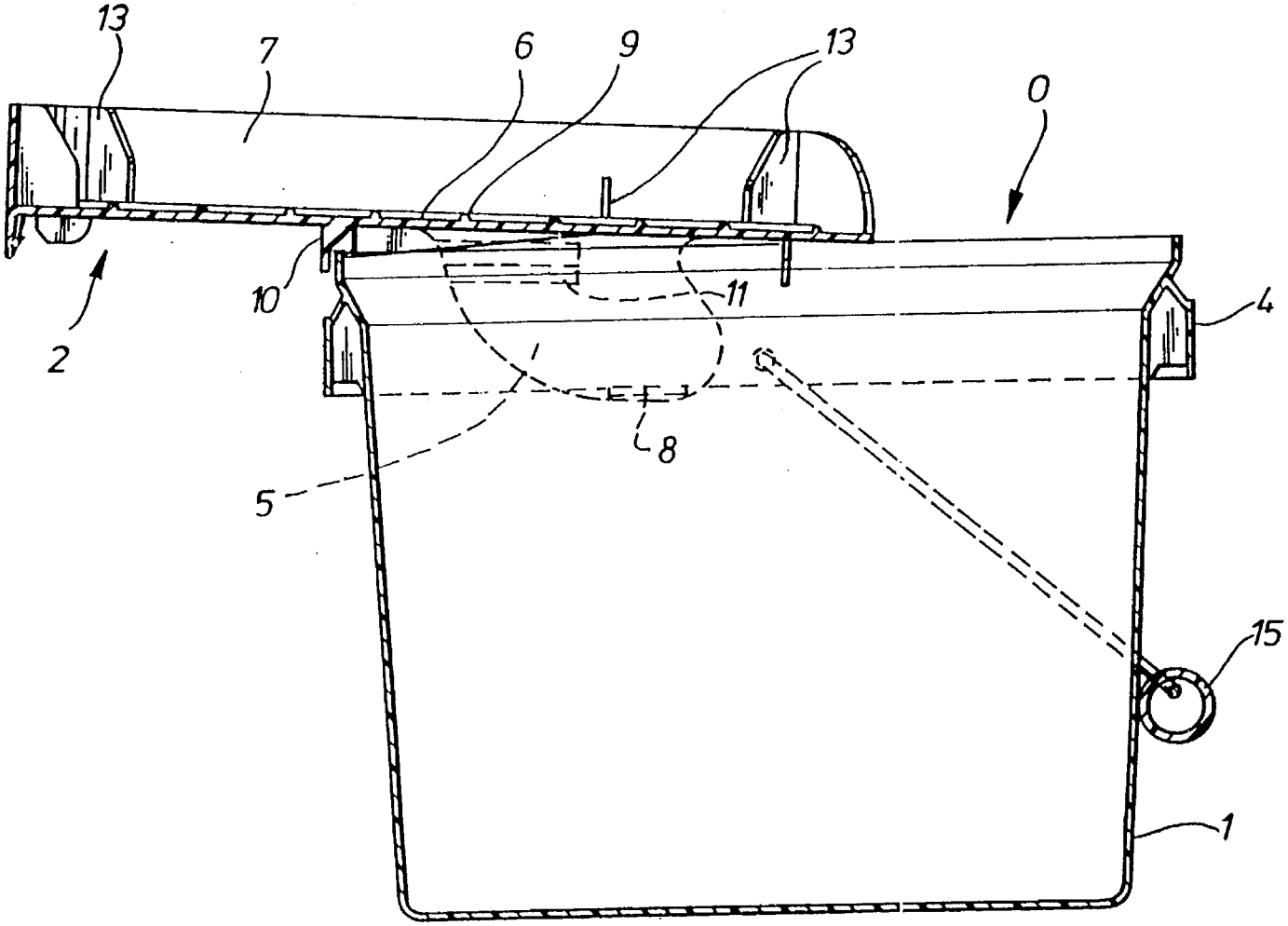
FIG. 3 is a section taken through central plane AA of FIG. 1.

FIGS. 2 and 3 show how the underside of the tray 2 is supported in the first position. A pair of ribs 10 extend across the underside of the tray 2 and are separated from each other by a gap which corresponds to the rim 4 of the paint container 1. At the top of the container 1 the rim 4 becomes thin and, as the tray 2 is placed in the first position, the rim 4 becomes engaged between the pair of ribs 10. The tray 2 is thereby located securely.

The ribs 10 also locate the rear of the tray 2 in an inclined position to enable paint to flow towards the container 1.

One of the ribs 10 may include a ramp leading up to its outermost point. This ramp enables the tray 2 to slide easily into the position. The rim 4 slides against the underside of the tray 2, up the ramp and over a rib 10 into the gap between the ribs 10.

The tray 2 is thus located in its first position wherein a roller may be inserted into the paint container 1 in order to apply paint to the roller. The roller may then be withdrawn and rolled along the roller tray 2 as required to remove excess paint from the roller nap to evenly distribute paint on the nap. The platform 6 of the tray includes ridges 9 embossed thereon in a pattern of lines of "wavy" or "herringbone" design to assist removal of excess paint and even distribution of the paint. The tray 2 is disposed at a slight inclination so that excess paint temporarily retained on the tray 2 by the flange 7 flows into the paint container 1 over that edge of the tray 2 which does not include a flange 7. To this end the tray 2 must overlap the access opening O as shown in FIGS. 1 to 3.

From the foregoing it will be appreciated that the paint container 1 acts as a reservoir from which paint is collected by the roller, and into which surplus paint drains. This overcomes the problem which is encountered with conventional roller trays where paint must be poured from the paint container into a well in the conventional roller tray causing unwanted mess and waste. It also reduces the mess and waste at the end of a paint job where paint remains in the well of the conventional roller tray. Since the well of the present invention is the paint container itself, it is unnecessary to pour paint out of or into a separate well.

When the paint job has been finished, the tray 2 may be unclipped from the container 1 by spreading the lugs 5 and lifting the tray 2 away. The tray 2 may then be washed, the lid 3 placed upon the paint container 1 to seal the container, and the tray 2 clipped onto the lid 3 of the container 1 so that the tray 2 is stored with the paint.

Since each container 1 of paint is sold with a new roller tray 2, paint is less likely to be contaminated by use of a old and possibly dirty tray, or by flakes of a different coloured paint remaining on the tray since it was previously used.

According to a specific embodiment of the invention, the tray 2 has a rib 10 extending from its underside and in a central region which engages or abuts the rim 4 of the paint container and causes the tray 2 to be slightly downwardly inclined towards the access opening O to assist drainage from the tray into the container. The rib 10 also assists in locating the tray 2 on the container 1 stably and securely.

Figure 4:
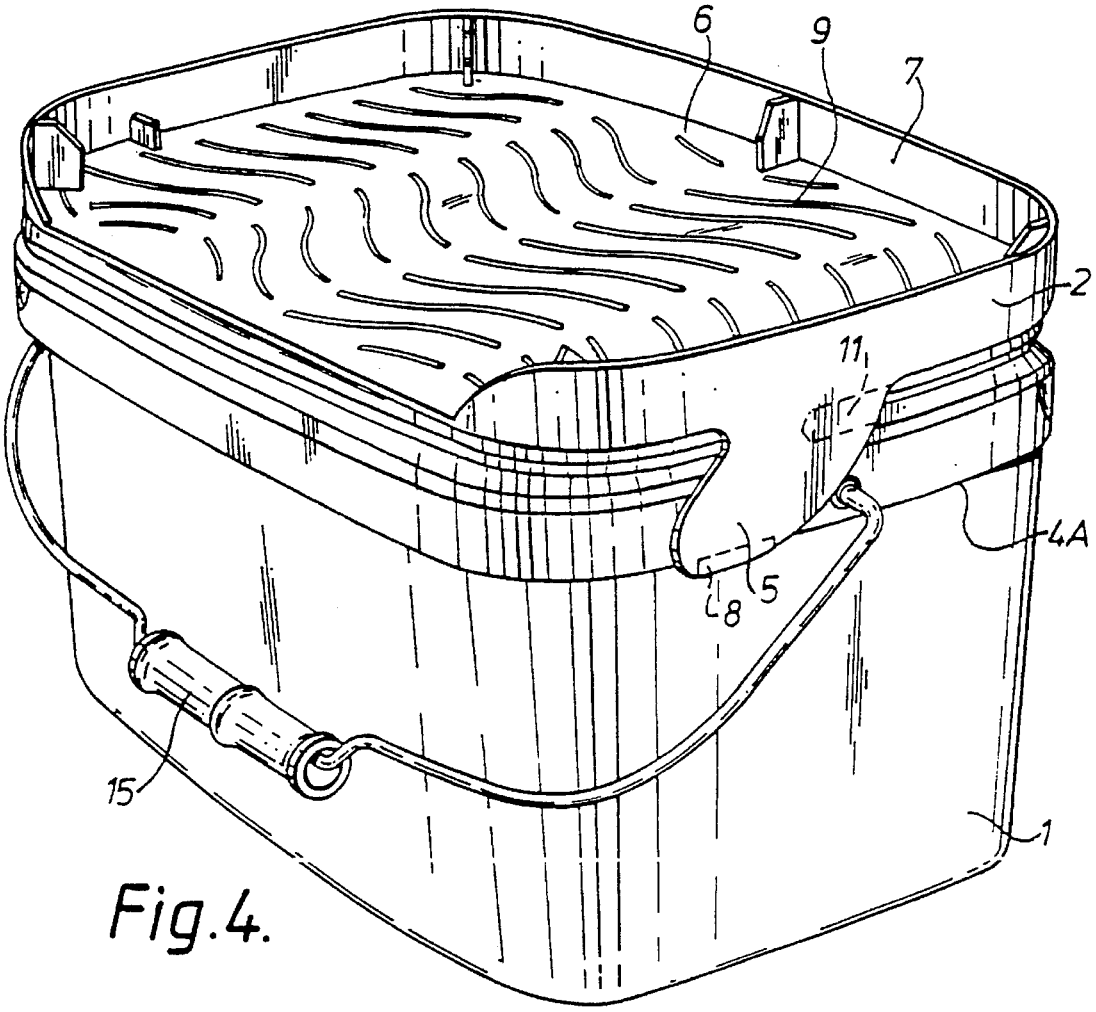
FIG. 4 is a perspective of the invention in the second position with a lid closing the top of the container.
Figure 5:
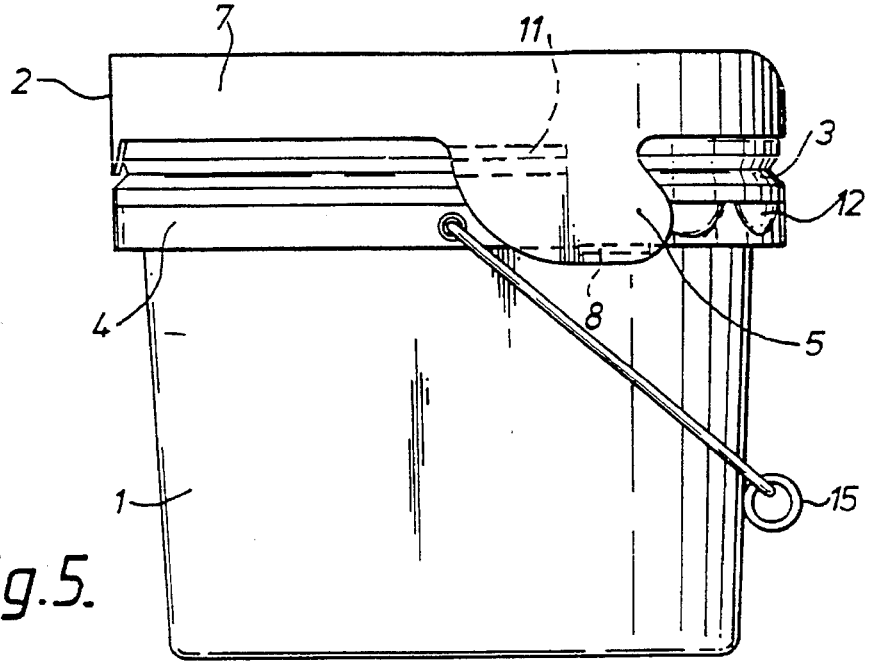
FIG. 5 is an end view of FIG. 4.
Figure 6:
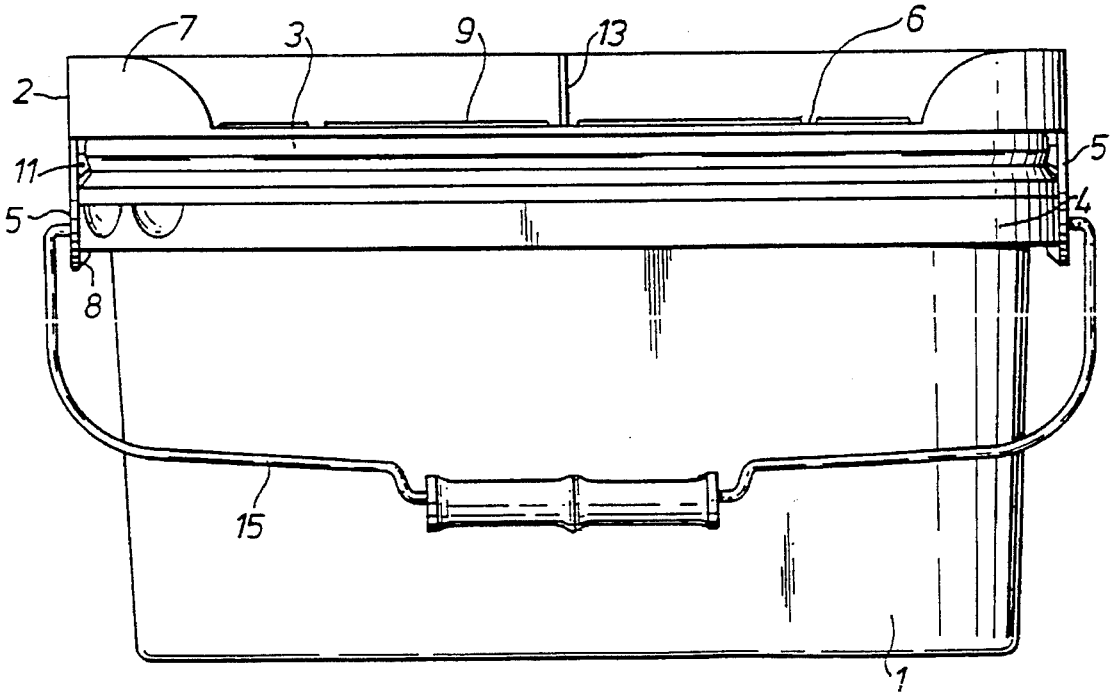
FIG. 6 is a front view of FIG. 4.

Referring to FIGS. 4–6, the paint is sold in the paint container 1 which is enclosed by the lid 3. The roller tray 2 is normally sold with the container of paint 1, clipped to the container 1 above the lid 3 in the second position. The attachment lugs 5 of the tray 2 pass over the side of the lid 3 and the projections 8 engage with the rim 4 of the paint container 1 and or with the lid 3. In a preferred embodiment each attachment lug 5 includes two projections 8,11, one of which cooperates with the rim 4 of the container 1, and the other is shaped to cooperate with a contour of the lid 3.

In the second position, the platform 6 of the tray 2 lies flat atop the lid 3 and is aligned therewith. There is no displacement of the tray 2 to the rear of the container 1. The tray 2 is of a similar size and shape as the lid 3.

To remove the tray 2, the attachment lugs 3 are pulled outwardly away from the container 1, and the tray lifted away from the lid.

The lugs 5 are made from a resilient material which permits sufficient flexure for removal.

The lid 3 may then be removed from the paint container 1 to open the container 1. Two depressions 12 are present on the rim 4 of the container 1 to enable a person to grip the lid by getting their fingers under a corner of the lid 3.

In order to place the container 1 into use, once the tray 2 and lid 3 have been removed, the tray 2 is placed in the first position. This may be done either by outwardly deforming the attachment lugs 5 slightly and lowering the tray 2 into the first position in which the projections 8 engage with the rim 4 of the container 1, or by sliding the tray 2 on from the rear of the container 1 so that the projection 8 slide under the rim 4 until the tray 2 is correctly positioned.

Most rectangular paint containers 1 are tapered slightly from top to bottom. Therefore the combination of tray 2 and container 1 as sold will stack in a manner similar to conventional containers for storage and warehousing. Because the bottom surface of a container 1 is generally somewhat smaller than the tray 2 beneath it in a stack, it is advantageous for the roller platform 6 to have locating means 13 to keep each subsequent container in a stack with respect to those below it. This reduces the likelihood of stacks leaning due to each subsequent container 1 being offset slightly from the previous one.

Figure 8:
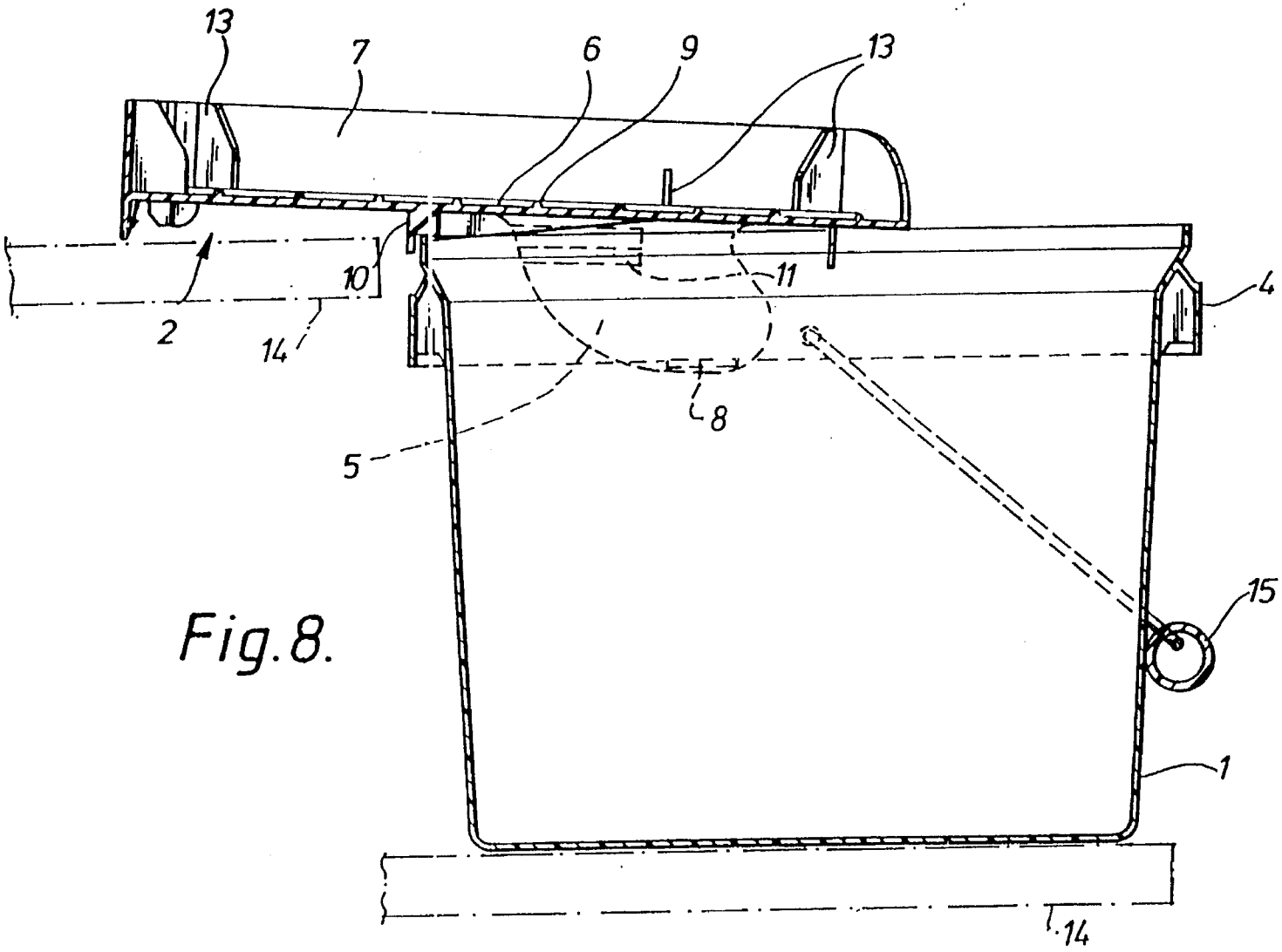
FIG. 8 is a view of the invention on a step-ladder.

Referring to FIG. 8, it has been found particularly advantageous to dimension the combination of container 1 and tray 2 so that the base of the container 1 will sit on one tread 14 of a step ladder while the overhanging portion of the tray 2 will sit on the tread 14 above it. In FIG. 8, this is achieved using a container 1 which corresponds to the height between the treads 14, although the tray 2 could be provided with means (such as retractable of folding legs or suchlike) for adjustment to cope with different heights. Typical tread heights are 6 to 9 inches and so containers 1 having a height in this range are particularly preferred. This is a particularly stable arrangement which avoids the instability problems associated with known trays and minimizes the need to hold the tray in place on the ladder and the risk of the tray falling from its position.

Preferably, the tray 2 is made from polypropylene since this is very resilient, resistant to aqueous paints, capable of withstanding high stacking loads, of low cost and good appearance and provided the correct degree of resilience to the lugs (5).

The container 1 also includes a handle 15 which is attached to the rim 4 of the container 1. The rim 4 therefore extends downwardly beyond the lowest extent of the lid 3 when placed over the container 1 to seal it.

In a further embodiment of the present invention (not illustrated), the container is sold without a separate lid, but the underside of the tray is adapted to close the container when placed in the second position. The tray therefore constitutes a lid. To use the paint, the tray is simply removed from its second position and placed into its first position.

To reduce the likelihood of paint soiling the underside of the tray, a membrane is included which may be removed or peeled back before the paint is used. The membrane may be a foil similar to foils used to seal yoghurt pots, or may be a piece of impermeable paper on the surface of the paint.

I claim:

1. A paint roller tray detachably mountable on a paint container, the paint container including a removable lid, the container having an opening permitting access of a paint roller into the container, the removable lid adapted to close the opening, the paint roller tray comprising:

a roller platform, and attachment means which allow the tray to be mounted in one of a first and second position on the container, wherein in the first position, the attachment means are engaged so as to locate the roller platform above the container and laterally offset from the opening so as to permit insertion of the roller into the container, and wherein in the second position, the attachment means is engaged to locate the roller platform on the removable lid so as to be detachably connected to the lid, the roller platform being located immediately above the container.

2. A tray as claimed in claim 1 wherein the container is rimmed and the attachment means engage the rim when the tray is in at least the first or second position.

3. A tray according to claim 1 wherein the attachment means include lugs extending from the roller platform.

4. The tray according to claim 3 wherein the attachment means further include primary projections extending from the lugs which are engagable with the rim of the paint container.

5. The tray according to claim 1 adapted to permit centralized stacking of the paint containers when in the second position.

6. The tray according to claim 1 wherein the roller platform includes an embossed pattern.

7. The tray according to claim 6 wherein the embossed pattern includes a plurality of curves.

8. The tray according to claim 1 including a raised flange extending from the roller platform around a substantial part of the periphery of the roller platform.

9. The tray according to claim 1 which is inclined towards the paint container when located in the first position.

10. The tray according to claim 9 wherein excess paint may drain back into the container by virtue of the inclined tray.

11. The tray according to claim 1 adapted to be located on a rectangular section container.

12. The tray according to claim 1 wherein when the tray is in the first position on the container, a distance from a bottom surface of said container to a bottom surface of said tray is substantially equal to a separation between steps of a step ladder.

13. A paint roller tray detachably mountable on a paint container, the paint container including a removable lid, the container having an opening permitting access of a paint roller into the container, the removable lid adapted to close the opening, the paint roller tray comprising:

a roller platform, and attachment means which allow the tray to be mounted in one of a first and second position on the container, wherein in the first position, the attachment means is engaged so as to locate the roller platform above the container and laterally offset from the opening so as to permit insertion of the roller into the container, wherein in the second position, the attachment means is engaged to locate the roller platform immediately above the container over the opening, wherein the attachment means includes lugs extending from the roller platform, and wherein the attachment means includes secondary projections extending from the lugs, the secondary projections being engageable with the lid.

14. The tray according to claim 13 wherein the edge of the lid is contoured to retain the secondary projection.

15. A method of painting including the steps of:

providing a paint container having a removable lid, the paint container containing paint, removing the lid from the container, detachably supporting a paint roller tray including a roller platform in a first position located in an overlapping relationship with an access opening of a paint container to permit access into the container, attachment means of the tray being engaged with the paint container, the container being closable by reattaching the lid and moving the tray to a second position where the tray is immediately above the container and attached to the lid.

* * * * *